US005920907A

United States Patent [19]

Pierce

[11] Patent Number: 5,920,907

[45] Date of Patent: Jul. 13, 1999

[54] NECK TIE CLASP

[76] Inventor: Tod M. Pierce, 11041 S. Ridgeway Ave., Chicago, Ill. 60655

[21] Appl. No.: 09/127,569

[22] Filed: Jul. 31, 1998

[51] Int. Cl.[6] ..... A41D 25/02

[52] U.S. Cl. ..... 2/152.1; 2/148

[58] Field of Search ..... 2/144, 148, 152.1, 2/153, 154

[56] References Cited

U.S. PATENT DOCUMENTS

| | | | |
|---|---|---|---|
| 2,316,002 | 4/1943 | Koivisto | 2/144 |
| 2,631,292 | 3/1953 | Cunningham | 2/153 |
| 3,745,614 | 7/1973 | Tsang | 24/153 |
| 3,958,277 | 5/1976 | Girdler | 2/148 |
| 4,995,118 | 2/1991 | Paduano, Sr. | 2/150 |
| 5,216,757 | 6/1993 | Dorkin | 2/152 R |
| 5,390,370 | 2/1995 | Koy | 2/153 |
| 5,416,926 | 5/1995 | Koy | 2/153 |
| 5,432,953 | 7/1995 | Kim | 2/148 |
| 5,493,731 | 2/1996 | Amnott | 2/148 |

*Primary Examiner*—John J. Calvert
*Assistant Examiner*—Tejash D Patel
*Attorney, Agent, or Firm*—Joseph N. Breaux

[57] ABSTRACT

A triangular shape neck tie clasp with tie end receiving apertures located on a top portion of two side edges of the triangular tie clasp body, and wherein the apertures are interconnected with channels passageways which are in communication with a back surface of the tie clasp by the use of a continuous groove. The grooves and channels provides a means for placing one end of the tie through one side edge aperture and extending that end to the bottom aperture while at the same time extending the other end of the tie through the other side edge aperture and extending through the same bottom aperture, the tie ends are then adjusted for length and the neck tie clasp adjusted for placement. Decorative surfaces are easily attached to a decorative surface portion of the tie claps body by a central decorative surface attachment means. Decorative outer surfaces are provided with numerous decorative finishes including gold, silver, jewels, cloth or any other decorative surface desired.

4 Claims, 2 Drawing Sheets

NECK TIE CLASP

TECHNICAL FIELD

The present invention relates to devices and methods for neck ties and more particularly to devices and methods for a neck tie clasp which provides a neck tie clasp body with interchangeable decorative surfaces which are provide with a number of decorative styles such as gold, silver or fabric covered plastic, while the neck tie clasp replaces the knot of the neck tie and allows a tie to be worn in a normal manner while also providing visual enhancement of a user's attire as a result of the devices decorative nature.

BACKGROUND ART

Fashion conscious individuals are continually attempting to make fashion statements by wearing bold new designs which are not only functional but stylish. The present device provides a useful neck tie clasp which is very easy to install upon a normal neck tie and which clasp enhances a tie by providing a removable and replaceable decorative surface. The present invention also provides a quick means of applying a neck tie and overcomes the problems associated with individuals who are too busy, inexperienced or unable to correctly tie a tie knot. Prior to the present invention there has never been a tie clasp which overcomes the associated problems with ties while also providing a decorative clasp. Prior art patents which are relevant are as follows:

Kim U.S. Pat. No. 5,432,953 which discloses a neck tie structure with a tie knot former.

Koy U.S. Pat. No. 5,416,926 which discloses a pre-tied neck tie knot support.

Koy U.S. Pat. No. 5,390,370 which discloses a knot support and pre-tied neck tie.

Borkin U.S. Pat. No. 5,216,757 which discloses a knot simulating neck tie clasp.

Paduano Sr. U.S. Pat. No. 4,995,118 which discloses a pre-tied neck tie set.

Tsang U.S. Pat. No. 3,745,614 which discloses a tie knot unit.

As can be seen from the prior art there has never been a neck tie clasp as the present which provides an easy to install clasp which is useable on any tie and which provides an interchangeable decorative surface which replaces a normal knot of a neck tie and which enhances the visual appearance of a neck tie and provides a means for quickly installing a neck tie for those who are inexperienced or unable to tie a normal neck tie knot.

GENERAL SUMMARY DISCUSSION OF INVENTION

It is thus an object of the invention to provide a Neck Tie Clasp that is a decorative device that will replace a neck tie knot.

It is a further object of the invention to provide a Neck Tie Clasp which includes an interchangeable decorative surface wherein the decorative surface is be supplied in a number of decorative finishes including gold, silver, or fabric covered plastic, further wherein the decorative surface is attached to a neck tie clasp body that replaces a knot of a neck tie and allows the tie to be worn in a normal manner while providing visual enhancement due to the devices decorative nature.

It is a still further object of the invention to provide a Neck Tie Clasp that has a triangular shape neck tie clasp body with three holes in side edges of the body, one hole on each upper area of each side of the triangular body, and one hole at the bottom of the triangular shaped body, the holes extend internally through the body and intersect within the triangular body to form a continuous tie channel through the body, while the channels are further in communication with the back surface of the body by grooves which extend along the channels on the back surface and which provide locations for inserting the neck tie portions to be secured into the channels and secured by the tie clasp.

It is a still further object of the invention to provide a Neck Tie Clasp that includes a decorative surface with interchangeable decorative portions attachable to a visual surface of the neck tie clasp body.

Accordingly, a Neck Tie Clasp is provided for replacing a conventional neck tie knot for use in connection with a conventional neck tie that includes a triangular shape neck tie clasp body with three holes in side edges of the body, one hole on each upper area of each side of the triangular body, and one hole at the bottom of the triangular shaped body, the holes extend through the body and intersect within the triangular body to form a continuous tie channel through the body, while the channels are further in communication with the back surface of the body by grooves which extend along the channels on the back surface and which provide locations for inserting the neck tie portions into the channels to be secured by the tie clasp, and an attachment surface is provided on a forward facing surface of the clasp for allowing the wearer to interchange a number of ornamental decorative surfaces for a variety of aesthetic effects.

BRIEF DESCRIPTION OF THE DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from the following description that in use anyone who desires to wear a neck tie without the problems associated with tying a knot and any persons who desire wearing a neck tie with a decorative tie clasp would simply slip each tie end into the neck tie clasp grooves, one tie end starting at each upper area side edge hole, located on the tie clasp back surface and pull them through the channels and then both tie ends are pulled together to the bottom hole of the neck tie body. Tie end lengths are adjusted as desired. A front visual surface of the neck tie clasp body has a central attachment aperture for attaching numerous decorative outer surfaces to the tie clasp body. The user would then enjoy the benefits of having a very inexpensive, easy to use, and aesthetically pleasing method of wearing a tie without the worry of tieing a knot. The decorative outer surface may be provided in a number of decorative surfaces including gold, silver, jewels, cloth, leather, plastic or any other material which may decorate the tie clasp.

Figure 1:
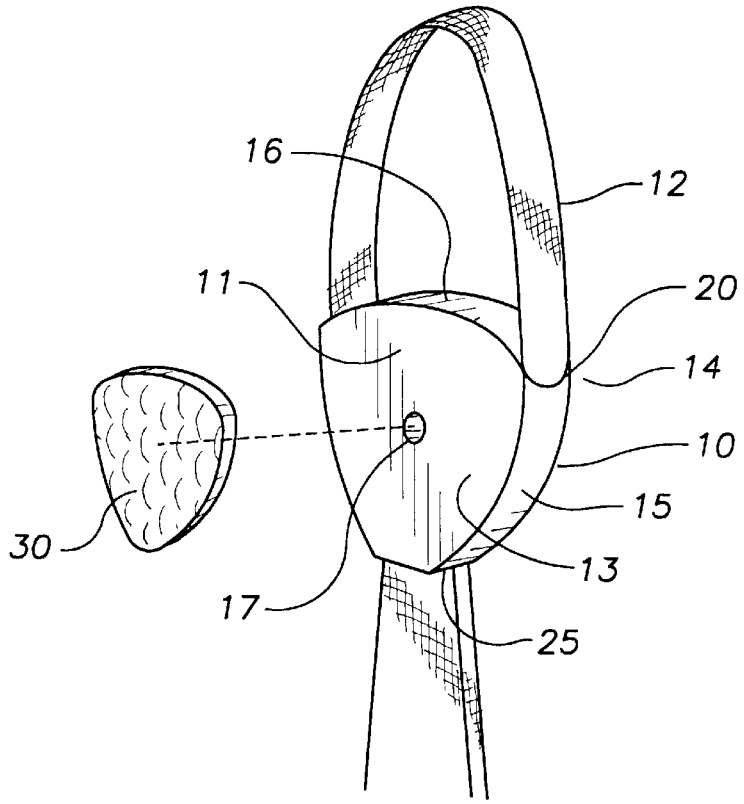
FIG. 1 is an isometric view of the neck tie clasp body illustrating the placement of the clasp on a tie, and the removal of a decorative outer surface.
Figure 2:
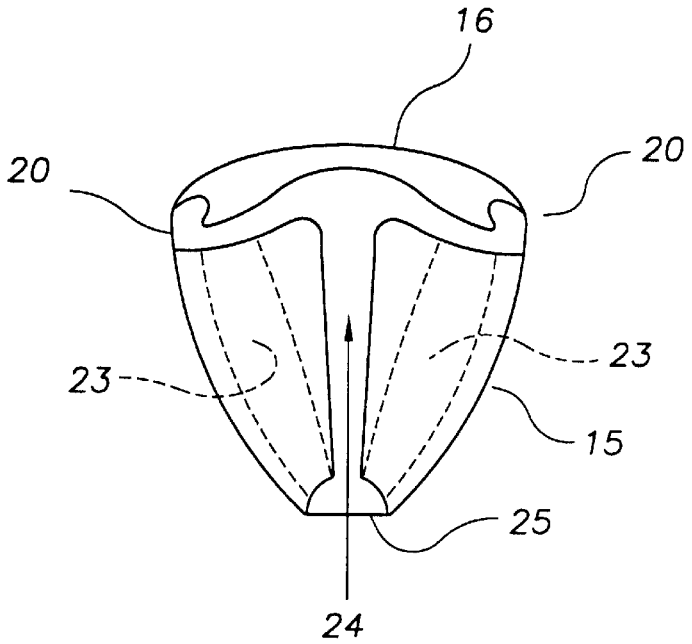
FIG. 2 is a back view of the neck tie clasp body illustrating the neck tie interconnected channels which receive the tie.

Referring to the figures in detail, FIG. 1 illustrates the tie clasp 10 attached to a normal neck tie 12. The tie clasp 10 comprises a triangular tie clasp body 11 which has a decorative attachment surface 13, a back surface 14, side edges 15, top edge 16 which extends between two side edge apertures 20, and a bottom aperture 25. The triangular body 10 is preferably constructed of durable plastic material and pigmented to blend in with clothing. The back surface 14 of the triangular body is illustrated in FIG. 2. As can be seen in FIG. 2 an interconnecting channel 23 interconnects the side edge apertures 20 and the bottom aperture 25. The channel 23 is preferably slightly larger in diameter than a groove 24 which runs the entire length of the channel 23 and provides access to the interconnecting channels. The slightly smaller width of the groove 24 provides a means of assuring that the tie portion stays within the channel 23 when the tie portions are placed in the channel 23. When a user would like to install the tie clasp body 11 one end of the tie is placed through one of the side edge apertures 20 and placed through the groove 24 and into the channel 23 and run down to the bottom aperture 25 while at the same time the other end of the tie is place in the other side aperture 20 and similarly placed through the groove 24 and into the channel 23 and extended down to the bottom aperture 25. At this point both ends of the tie are exiting the bottom aperture 25. The ends of the tie are then adjusted for length while the tie clasp body is drawn up to a person's collar or placed where desired.

Figure 3:
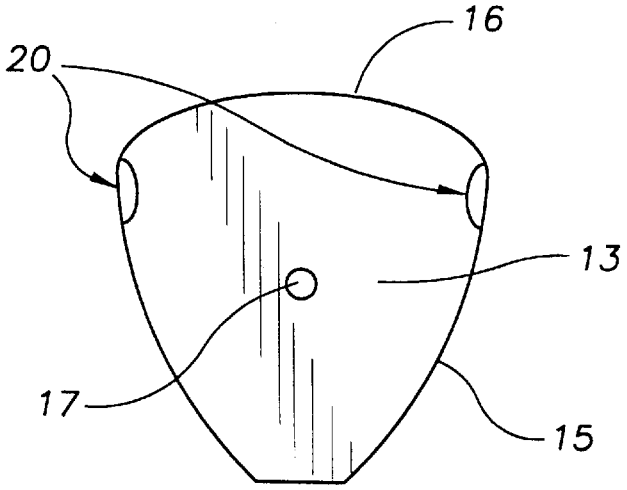
FIG. 3 is a front view of the neck tie clasp body illustrating the side edge holes and the central decorative surface attachment aperture.

FIG. 3 illustrates a front surface 13 of the triangular tie clasp body. A centrally located decorative member attachment aperture 17 is provided for attaching a decorative surface 30 to the front surface 13 of the tie clasp 10. The decorative member 30 includes a protrusion 31 which is received by central aperture 17 and provides a means for securing the decorative member 30 to the tie clasp body 11. The attachment means 31 and 17 mean include a snap arrangement or any other receiving means which would securely attaches the decorative member 30 to the front surface 13 of the tie clasp body 11.

Figure 4:
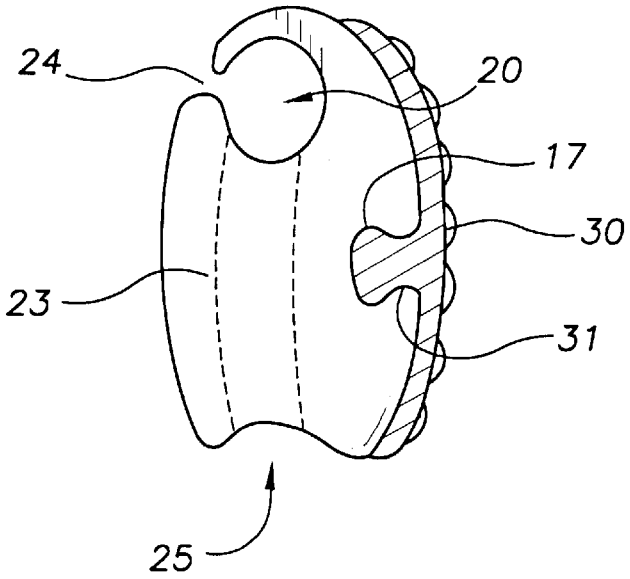
FIG. 4 is a side view cross section illustrating the attachment of the decorative surface on the neck tie body and the interconnecting channels between the three holes in the neck tie body side edges.

FIG. 4 illustrates a cross-sectional side view of the tie claps and shows the interconnecting channels 23 extending from the bottom aperture 25 and the two side apertures 20.

The decorative attachment portion 30 may include numerous types of decorative surfaces including gold, silver, gems, simulated gem stones, cloth, leather, animal skins, textured plastic or any other decorative surface which a user may desire to accent or enhance one's attire. The user may desire to change decorative members 30 to match a particular suit.

It is noted that the embodiment of the Neck Tie Clasp described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A Neck Tie Clasp comprising:

a) a triangular neck tie clasp body with a front decorative attachment surface, a back surface, two side apertures located on an upper end of each side edge and separated by a horizontal top edge, a bottom aperture, interconnecting channels extending through the neck tie clasp body and extending from each side edge aperture and to the bottom aperture, a tie insertion groove extending the length of the interconnecting channels and providing access into the interconnecting channels from the back surface of the clasp body, and a decorative attachment aperture centrally positioned on the front decorative attachment surface, and b) a decorative attachment portion dimensioned to fit upon the front decorative attachment surface on the clasp body, the decorative attachment includes a decorative surface and an attachment protrusion position on a back surface of the decorative attachment portion and dimensioned to engage with the decorative attachment aperture on the front decorative attachment surface and securely attach the decorative attachment portion to the front attachment surface;

the tie insertion groove being smaller in width than the diameter of the interconnection channels.

2. The Neck Tie Clasp of claim 1, wherein the clasp body further comprises a clasp body constructed of plastic which is pigmented, so that the clasp body matches a user's clothing as desired.

3. The Neck Tie Clasp of claim 1 wherein the decorative attachment portion further comprises a decorative surface which may be composed of precious metal, gem stone(s), animal skin(s), textured man made decorative material and the like.

4. The Neck Tie Clasp of claim 1 wherein the neck tie clasp further comprises numerous decorative attachment portions with various decorative surfaces providing numerous variations for altering the appearance of the neck tie clasp.

* * * * *